United States Patent [19]

Skinner et al.

[11] Patent Number: 4,510,040

[45] Date of Patent: Apr. 9, 1985

[54] COAL LIQUEFACTION PROCESS

[75] Inventors: Ronald W. Skinner, Allentown; John C. Tao, Perkiomenville, both of Pa.; Samuel Znaimer, Vancouver, Canada

[73] Assignee: International Coal Refining Company, Allentown, Pa.

[21] Appl. No.: 549,694

[22] Filed: Nov. 7, 1983

[51] Int. Cl.[3] ..... C10G 1/06; C10G 1/00; C10G 7/00; C10G 17/04

[52] U.S. Cl. ..... 208/10; 208/8 LE; 208/366; 208/312; 208/315; 208/322

[58] Field of Search ..... 208/8 LE, 10, 366, 312, 208/315, 322

[56] References Cited

U.S. PATENT DOCUMENTS

| | | | |
|---|---|---|---|
| 4,070,268 | 1/1978 | Davis et al. | 208/8 |
| 4,094,766 | 6/1978 | Gorin | 208/10 |
| 4,119,523 | 10/1978 | Baldwin et al. | 208/8 |
| 4,164,466 | 8/1979 | Baldwin et al. | 208/8 LE |
| 4,189,372 | 2/1980 | Baldwin et al. | 208/8 LE |
| 4,230,556 | 10/1980 | Carr et al. | 208/8 LE |
| 4,251,346 | 2/1981 | Dry et al. | 208/10 |
| 4,264,429 | 4/1981 | Rosenthal et al. | 208/10 |
| 4,264,430 | 4/1981 | Kuehler | 208/10 |
| 4,300,996 | 11/1981 | Kuehler | 208/10 |
| 4,328,088 | 5/1982 | Anderson et al. | 208/8 LE |
| 4,334,977 | 6/1982 | Derbyshire et al. | 208/8 LE |
| 4,338,182 | 7/1982 | Vernon et al. | 208/8 LE |
| 4,347,117 | 8/1982 | Bareman et al. | 208/8 LE |
| 4,372,838 | 2/1983 | Kulik et al. | 208/10 |
| 4,374,015 | 2/1983 | Brulé208 | 8 LE/ |
| 4,377,464 | 3/1983 | Carr et al. | 208/8 LE |

*Primary Examiner*—William G. Wright

*Attorney, Agent, or Firm*—Kimbley L. Muller

[57] ABSTRACT

This invention relates to an improved process for the production of liquid carbonaceous fuels and solvents from carbonaceous solid fuels, especially coal.

The claimed improved process includes the hydrocracking of the light SRC mixed with a suitable hydrocracker solvent. The recycle of the resulting hydrocracked product, after separation and distillation, is used to produce a solvent for the hydrocracking of the light solvent refined coal.

5 Claims, 1 Drawing Figure

COAL LIQUEFACTION PROCESS

BACKGROUND OF THE INVENTION

The Government of the United States of America has rights in this invention pursuant to Contract No. DE-AC05-780R03054 (as modified); awarded by the U.S. Department of Energy.

This invention relates to the process for the liquefaction of carbonaceous solid fuels, particularly coals with respect to enhanced production of liquid carbonaceous fuels and solvents.

Many processes have been proposed for the production of low-sulfur, low-ash, carbonaceous fuels and distillate hydrocarbon fuels by solvent refining of coal in the presence of a hydrogen donor solvent. Typically, such a process includes the heating and liquefaction of the coal yielding light gases and a slurry which is further processed by vacuum distillation to produce a light distillate product, a recycle solvent, and a heavy fraction, including residual solvent, dissolved coal products, undissolved coal, minerals or ash materials.

It is well known that further products may be produced by subjecting the vacuum still bottoms to a solvent deashing process which is sometimes referred to as "critical solvent deashing." Such a process is disclosed in U.S. Pat. No. 4,070,268. As indicated in that patent, the products of the critical solvent deashing process include a stream which is rich in coal products soluble in pyridine, but which is essentially free of ash and unconverted particulate coal. A bottom stream is also produced which includes insoluble coal products and ash. Finally, an underflow stream of LSRC is produced which is either recycled as solvent in the deashing process or removed as a product.

As shown by U.S. Pat. No. 4,164,466, the solvent deashing stage often comprises several separation zones, each maintained at successively higher pressures and at high temperatures. This patent also discloses a process wherein the underflow stream of the second zone in the deashing stage is recycled to the entry mixing zone in the deashing stage.

In the process disclosed in U.S. Pat. No. 4,189,372, a portion of the underflow from the third and fourth separators is hydrogenated and recycled to the coal liquefaction slurry tank. Substantially all other intermediate streams from the second through the fourth separators are recycled to the entry mixing zone of the solvent deashing stage as in the U.S. Pat. No. 4,164,466.

In U.S. Pat. No. 4,119,523, the underflow from the first separator in the solvent deashing stage is extracted to separate the resulting ash and undissolved coal, and the remaining extract recycled to the coal liquefaction stage.

U.S. Pat. No. 4,298,451 teaches the catalytic hydrocracking of a clean coal extract 500° F.+ (260° C.+). The process disclosed uses a catalytic ebullating bed hydrocracker maintained at a temperature of 750°–825° F. (399°–441° C.) and a hydrogen pressure of 2000–3000 psi (13793–20689 Kpa). The preferred catalyst is NiMo.

The fixed-bed hydrocracking of Solvent Refined Coals and similar coal-derived materials have been studied extensively by several industrial concerns under various government contracts. The results of this research indicated that hydrocracking of SRC was not promising due to bed plugging and catalyst deactivation on short test runs, particularly at high conversion efficiencies and rates.

UOP studies included: "Characterization of Coal Liquids, Intermediate Report on Upgrading SRC Filtrate," FE-2101-04, 9/76; "Characterization of Coal Liquids, Intermediate Report, Upgrading Solvent Refined Coal," FE-2010-06, 11/76; "Characterization of Coal Liquids, Intermediate Report, Upgrading Synthoil," FE-2010-03, 8/76; "Characterization of Coal Liquids, Intermediate Report on Upgrading Cut Back Solvent Refined Coal," FE-2010-02, 5/76; all by A. J. deRosset.

Chevron studies included: "Refining and Upgrading of Synfuels from Coal and Oil Shales by Advanced Catalytic Processes, Second Interim Report, Laboratory and Pilot Plant Studies of the Processing of SRC-I," FE-2315-45, 11/79; "Refining and Upgrading of Synfuels from Coal and Oil Shales by Advanced Catalytic Processes, April–June, 1977, FE-2315-55, 11/77; "Refining and Upgrading of Synfuels from Coal and Oil Shales by Advanced Catalytic Processes, Quarterly Report, April–June, 1979, FE-2315-40, 7/79; all by R. F. Sullivan, et al.

Finally, Air Products and Chemicals studies included: "Chemical Characterization, Handling and Refining of Solvent Refined Coal to Liquid Fuels, Final Report," FE-2003-2, 9/77, by Givens, et al.; and "Comparison of Trickle-Bed and Upflow Hydrotreating of SRC," APCI Report No. 87-0-884.01, 10/77, by M. A. Collura. While Air Products' work showed no bed plugging and little catalyst fouling, conversion efficiencies were very low, generally below 30%.

The November, 1979 Chevron report detailed efforts to catalytically hydrocrack SRC-I using a fixed bed reactor. The report concluded in part, "Our test . . . showed that under certain circumstances SRC-I can be processed . . . in a fixed bed without bed plugging. However, the catalyst fouled rapidly; and the product contained a substantial amount of 850° F.+ (454° C.+) material. Hydrogen consumption was high. The demonstrated catalyst life would not be acceptable by petroleum processing standards."

In view of this prior art, there remains a need for further varieties of products and enhancements to the process of coal liquefaction including fixed bed hydrocracking.

It is, therefore, the general object of the present invention to provide such products and improved processes.

BRIEF DESCRIPTION OF THE INVENTION

The present invention involves a solvent coal refining process in which, following liquefaction and light gas separation, the coal slurry is subjected to vacuum distillation, the bottom stream of which is solvent deashed. This solvent deashing includes a sequence of separation steps at elevated temperature and pressure. The present invention involves an improvement in the process wherein "Light SRC" is the favored product, the "Heavy SRC" being recycled almost to extinction. Such Light SRC is, in turn, hydrocracked on a fixed catalyst bed to yield commerically useful liquid fuels.

The term "Light SRC" or "LSRC" refers to and defines that SRC material which is comprised of approximately one third ($\frac{1}{3}$) oils which are pentane-soluble, and two thirds ($\frac{2}{3}$) asphaltenes, which are pentane insoluble, benzene soluble. LSRC has a softening point of about 180° F. (82.2° C.).

The term "Heavy SRC" or "HSRC" refers to and defines that SRC material which is comprised of approximately equal amounts of asphaltenes which are pentane insoluble, benzene soluble and preasphaltenes which are benzene insoluble, pyridine soluble with only a trace amount (about 1%) soluble in pentane. HSRC has a softening point of about 380° F. (193.3° C.).

In the preferred form of the present invention, coal, recycle solvent, and hydrogen are mixed, preheated, and reacted in a dissolver vessel of a type which is well-known in the coal liquefaction art. The dissolver effluent, comprising a mixture of hydrogen, water, vapor, light hydrocarbon gases, light oil, solvent, solvent refined coal (SRC), insoluble carbon, and ash, is sent to a high-pressure, high-temperature separator to remove most or all of the vapor-phase material for recovery as recycle hydrogen and condensate products.

The underflow from the separator is directed to a distillation system for recovery of the process solvent and then to a critical solvent deashing system for separation of oils and asphaltenes from solids and preasphaltenes. The residue stream consisting of unconverted coal, minerals, and preasphaltenes is sent to a gasifier system. The Heavy SRC product is recycled to the dissolver. Finally, the Light SRC is directed to a fixed bed hydrocracker and then to a separator which allows recovery of process solvents, products, and gases.

BRIEF DESCRIPTION OF THE FIGURE

The FIGURE is a schematic flow diagram of a coal liquefaction process with a fixed bed hydrocracker stage which is the process improvement of the present invention.

DETAILED DESCRIPTION OF THE INVENTION

Figure 1:
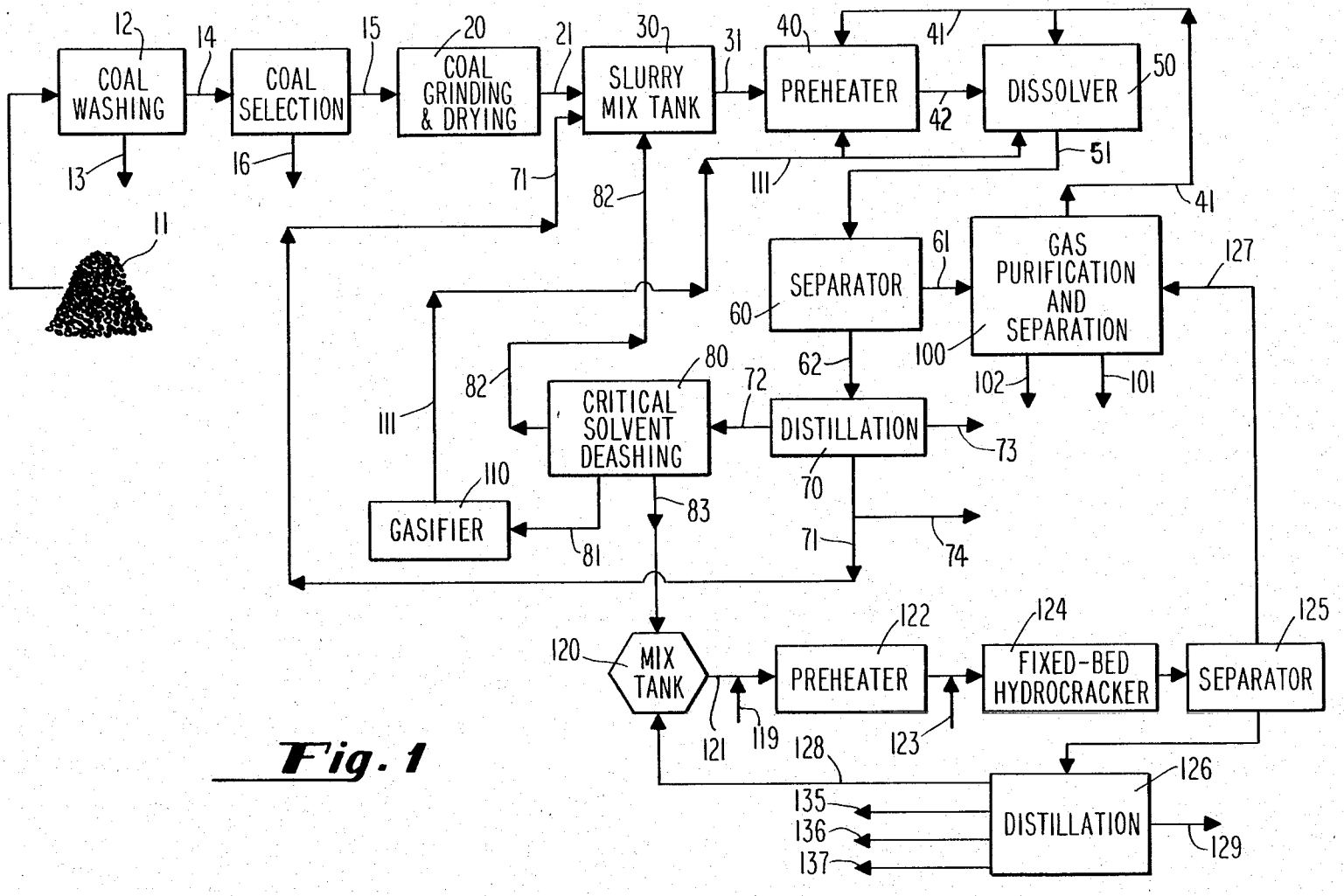

For a better understanding of the present invention, reference may be made to the detailed description which follows, taken in conjunction with the accompanying FIGURE and the claims.

Pulverized and dried feed coal 21 is passed to slurry mix tank 30 where it is slurried with process derived solvent introduced via feed line 71 and also mixed with any other downstream product, such as HSRC which is introduced via feed line 82. The slurried coal is passed through line 31 to preheater 40 where it is mixed with hydrogen, which is produced in downstream gas purification and separation system 100 and carried to preheater 40 by feed line 41. Additional makeup hydrogen from gasifier system 110 is introduced via feed line 111 if required. In preheater 40, slurried coal is passed at a high flow rate and heated to approximately 700°-800° F.

The effluent of the preheater 40 is passed via line 42 to dissolver 50 where it may be mixed with hydrogen, which is produced in downstream gas purification and separation system 100 and carried to dissolver 50 by feed line 41. Additional makeup hydrogen from gasifier system 110 is introduced via feed line 111 if required. The dissolver 50 can represent one or more dissolvers arranged in series or in parallel to which hydrogen may be added if desired.

The reacted effluent from dissolver 50 is passed via feed line 51 to separator system 60, wherein gaseous product is separated and sent via line 61 to gas separation and purification system 100 for condensation, separation and purification to produce a hydrogen rich gas stream, which is recycled via line 41 to the preheater 40 and the dissolver 50. Fuel gas is removed via line 101 and sulfur is removed via line 102.

The underflow condensed product from separator 60 is passed via line 62 to distillation system 70. Light distillate product boiling up to approximately 450° F. (232° C.) is collected and removed via feed line 73. A distillate of boiling range 450° F. (232° C.) to 850° F. (454° C.) is collected and a portion thereof is recycled to the slurry mix tank 30 via feed line 71. The balance of the distillate fraction represents increased yields of pentane soluble oils having fuel value and is removed via line 74.

The bottoms residue from distillation system 70 is passed via line 72 to critical solvent deashing unit 80. Insoluble material, comprising primarily coal and mineral ash materials, is passed to gasifier system 110 via feed line 81. Two deashed fractions are produced in critical solvent deashing system 80: an almost completely benzene-soluble light solvent refined coal (LSRC), which is fed to hydrocracker mixed tank 120 via line 83 in molten form; and a deashed solvent refined coal (HSRC) product, which may be recycled to the slurry mix tank 30 via line 82 where it constitutes part of the first stage process solvent, or alternatively removed as product.

Molten LSRC is sent from the critical solvent deasher 80 via feed line 83 to mix tank 120 where it is blended with hydrocracker recycle solvent from line 128. The ratio of LSRC to process solvent is at least 50:50 and preferably greater than 70:30. The ratio may be as high as 100:0. The mix tank is maintained at a temperature of at least 250° F. (121° C.) and preferably 400° (204°) to 500° F. (260° C.).

The LSRC solvent mixture flows via line 121 (with possible addition of hydrogen gas via line 119) to preheater 122 where it is heated to 600° (316°) to 750° F. (399° C.). Hydrogen may also be added after preheating via line 123.

The hydrogen and LSRC/solvent mixture may flow through the catalyst bed of the hydrocracker in either co-current upflow, co-current downflow (trickle bed), or counter-current (liquid downflow) modes. The adiabatic catalyst bed is operated at a temperature of 650° (343°) to 825° F. (441° C.) and pressure of 1500 (10345) to 3000 psig (20690 Kpa). Average conditions of about 750° F. (399° C.) and 2500 psig (17242 Kpa) are preferred.

The space velocity is set to give a single pass conversion of 850° F.+ (454° C.+) material to 850° F.− (454° C.−) material of 30 to 80%. The catalyst may be either nickel-molybdenum or cobalt-molybdenum on an alumina support. Although shown in the FIGURE as a single reactor vessel, hydrocracker 124 could consist of two or more reactors operated in series or parallel. Also, a guard bed of non-catalytic alumina may be placed between the preheater and the catalyst bed to remove metals which would otherwise deactivate the hydrocracking catalyst.

The fixed bed hydrocracker of the present invention offers several advantages over an ebullated bed system. First, the system using a fixed catalyst bed is less expensive to build and install. Second, the fixed bed obviates the need for an ebullator pump and its attendant expense and upkeep. Third, the fixed bed is operated adiabatically and is thus more thermally efficient than an isothermally run ebullated bed reactor.

Products from the fixed-bed hydrocracker 124 are sent to a separator 125. The gases recovered are directed to gas separation and purification system 100 via feed line 127. The liquid product from separator 125 is sent to vacuum distillation column 126 to separate the 850° F.− distillate from the 850° F.+ (454° C.+) two-stage liquefaction SRC which is directed through line 129. This two-stage liquefaction SRC (TSL SRC) can be used as a substitute for low sulfur number 6 fuel oil or as coker feedstock. The vacuum column also produces hydrocracker recycle solvent which is directed to the mix tank 120 via line 128, as well as product streams consisting of distillation cuts such as 400° F.− (204° C.−) materials 135, 400° F.-650° F. (204° C.-343° C.) materials 136, and 650° F.+ (343° C.+) materials 137.

We claim:

1. In a process for solvent refining coal, comprising forming a slurry of finely divided coal and a solvent therefor, contacting said slurry with hydrogen-rich gas, heating said slurry in the presence of said hydrogen-rich gas, reacting said heated slurry to dissolve at least some of said coal, adding fresh hydrogen as required to form a liquified coal slurry, passing said liquified coal slurry to a separator in which a vapor product stream and a condensed product stream are separated, passing the condensed product stream to a distillation system, and removing therefrom a residual bottoms product, passing said residual bottoms product to a critical solvent deashing process wherein said product is mixed with a deashing solvent to form a deashing stage slurry, passing said deashing stage slurry into deashing separators in which a light upper phase, a lower heavy phase, and a still heavier ash concentrate stream are separated, recycling said heavy lower phase to the head of the process, and passing said ash concentrate to a gasifier, the improvement wherein said light upper phase, consisting of Light Solvent Refined Coal is mixed with a suitable hydrocracker solvent in a ratio of at least 50:50 at a temperature of at least 250° F. (121° C.) and passed through a fixed catalyst bed hydrocracker operated at a temperature of at least 650° F. (343° C.) and a pressure of at least 1500 psig (1034 Kpa) the product of which is passed to a separator and then to a vacuum distillation apparatus, the fractions resulting therefrom constituting hydrocracker recycle solvent produced by the hydrocracking of said light solvent refined coal material and used as solvent for the hydrocracking of said Light Solvent Refined Coal and desired product materials.

2. The process of claim 1 wherein the first distillation system comprises:

(1) an atmospheric distillation step yielding a 550° F.+ (288° C.) stream; and (2) a vacuum distillation step yielding an 850° F.+ (454° C.) stream.

3. The process of claim 1 wherein the fixed bed hydrocracker is operated in a co-current upflow mode.

4. The process of claim 1 or claim 2 or claim 3 wherein the hydrocracker is operated so as to provide a conversion efficiency of 850° F.+ (454° C.+) material to 850° F.− (454° C.−) material of at least 30%.

5. The process of claim 1 or claim 2 or claim 3 wherein the hydrocracker is operated so as to provide a conversion efficiency of 850° F.+ (454° C.+) material to 850° F.− (454° C.−) material of at least 40%.

* * * * *